US005660315A

United States Patent [19]

Beavers et al.

[11] Patent Number: 5,660,315

[45] Date of Patent: Aug. 26, 1997

[54] LINE GUIDE AND GRIPPING MEANS FOR STAPLERS

[76] Inventors: Stacy A. Beavers, 2629 Hawaiian Ave., Medford, Oreg. 97504; Herbert D. Beavers, 275 Coachman Dr., Jacksonville, Oreg. 97530

[21] Appl. No.: 586,949

[22] Filed: Jan. 16, 1996

[51] Int. Cl.[6] ..... B25C 7/00

[52] U.S. Cl. ..... 227/156; 227/151

[58] Field of Search ..... 227/132, 147, 227/151, 156, 99, 109; 242/419, 419.4

[56] References Cited

U.S. PATENT DOCUMENTS

| | | | |
|---|---|---|---|
| 2,285,512 | 6/1942 | Harley | 227/132 |
| 2,668,290 | 2/1954 | Heller | 227/132 |
| 2,746,043 | 5/1956 | Heller | 227/132 X |
| 2,754,515 | 7/1956 | King . | |
| 2,775,763 | 1/1957 | Flammer | 227/132 X |
| 3,283,986 | 11/1966 | McKee | 227/151 X |
| 3,291,356 | 12/1966 | Armstrong | 227/156 X |
| 3,305,156 | 2/1967 | Khan | 227/132 |
| 3,310,215 | 3/1967 | Bostick | 227/132 X |
| 3,856,224 | 12/1974 | Van der Aa et al. | 242/419 |
| 4,537,343 | 8/1985 | Johansson | 227/156 X |
| 4,552,296 | 11/1985 | Sheng | 227/109 |
| 5,014,896 | 5/1991 | Reitmeier et al. | 227/99 X |
| 5,318,158 | 6/1994 | Seasholtz | 191/12 R |

*Primary Examiner*—Joseph J. Hail, III
*Assistant Examiner*—Jay A. Stelacone
*Attorney, Agent, or Firm*—Olson & Olson

[57] ABSTRACT

A guiding and gripping device for stapler is affixed in upright relation to the front surface of the stapler. The body member has a front contoured surface that receives a line being stapled and guides an unattached portion of the line in upright position along the front contoured surface. The front contoured surface also positions an unattached portion of the line laterally along the bottom surface in a position that is straddled by staples driven out of the bottom surface of the stapler. The front contoured surface includes a lower convex V-shaped groove for receiving an unattached portion of a line and that is bent thereover to impart friction to actual movement of the line. The front contoured surface also includes an upper projection having at least one guide surface offset laterally from the groove wherein a line that is bent over the groove and along one side of the laterally offset projection has angled engagement against the projection to further impart frictional clamping force on the line. The guiding and gripping device of the invention may take a form that can be attached to existing staplers or it can be integrated at the factory.

8 Claims, 4 Drawing Sheets

LINE GUIDE AND GRIPPING MEANS FOR STAPLERS

BACKGROUND OF THE INVENTION

This invention relates to new and useful improvements in staplers and in particular to staplers that have guiding and gripping means which assist in applying staples along a length of line to be fastened to a surface.

Securing a length of line such as wire and the like along a surface using a stapler has always required the use of both hands, one to pull the wire taut and position the unfastened portion for stapling, the other to operate the stapler. U.S. Pat. No. 2,754,515 includes a longitudinal groove or channel in the bottom thereof which serves as a guide for wire to be stapled to a surface. This allows the stapler to be placed in proper aligned relation on the wire to be stapled and also prevents the staple legs from accidentally passing through the wire insulation.

One disadvantage of this previously known structure for applying multiple staples along a wire is that it does not hold or grip the wire portion yet to be stapled in such a way that slack in the wire may be pulled taut without the use of the other hand, that is, the hand not operating the stapler.

Another disadvantage of this previously known structure is that it does not hold or grip the wire in such a way that the wire becomes attached to the stapler in an aligned position prior to the application of a staple.

SUMMARY OF THE INVENTION

An object of the invention is to provide line guide and gripping means for a stapler which overcomes the need for both hands to be used for applying staples along a length of line.

Another object is to provide line guide and gripping means for a stapler which holds or grips wire in such a way that slack in the line may be pulled taut without the use of two hands.

A further object is to provide line guide and gripping means for a stapler which holds or grips the line in such a way that the line has a frictional drag through the stapler as the stapler is moved along a line.

A further object is to provide line guide and gripping means for a stapler which can be quickly and easily connected and disconnected to a line portion that is yet to be stapled down.

Yet another object is to provide line guide and gripping means for a stapler that can be incorporated in a stapler as it comes from the factory or can be produced as an attachment for existing staplers.

In carrying out objects of the invention, the guiding and holding means is embodied in a front contoured surface on a stapler which is configured to position a line centered along the bottom surface of the stapler in a position that is straddled by a stapler to be driven out of the bottom surface of the stapler and also configured to provide friction drag means that applies a drag on a line extending through the front contoured surface, thus allowing a tensioning of the unattached portion of the line by advancing the stapler along a line in a direction away from a fixed or an already stapled portion of the line. The friction means comprises a convex V-shaped groove for receiving a line bent thereover that is being stapled, this groove being of a curvature that imparts a portion of said frictional clamping force on the line when the line is held in upright position around a portion of the groove. The guiding and gripping means also includes an upper projection that has at least one guide surface offset laterally from the groove wherein a line L that is bent over said groove and upwardly along one side of the laterally offset projection has angled engagement against the projection to further impart a frictional drag on the line. The guiding and gripping means can be applied to existing staplers or it can be integrated with the stapler at the factory.

The invention will be better understood and additional objects and advantages will become apparent from the following description taken in connection with the accompanying drawings.

DETAILED DESCRIPTION OF PREFERRED EMBODIMENTS

Figure 1:
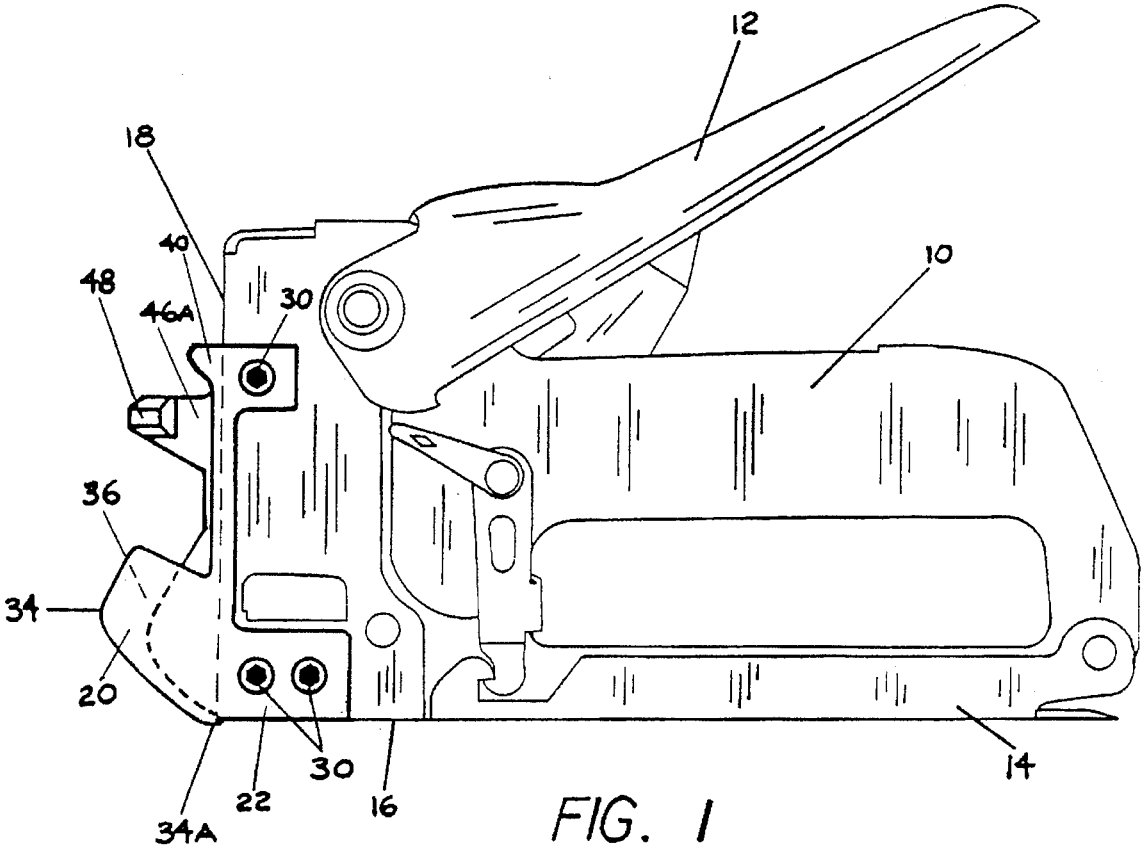
FIG. 1 is a side elevational view of a stapler with guiding and gripping means of the invention combined therewith, the guiding and gripping means comprising a first form of the invention wherein an attachment is applied to an existing stapler.
Figure 2:
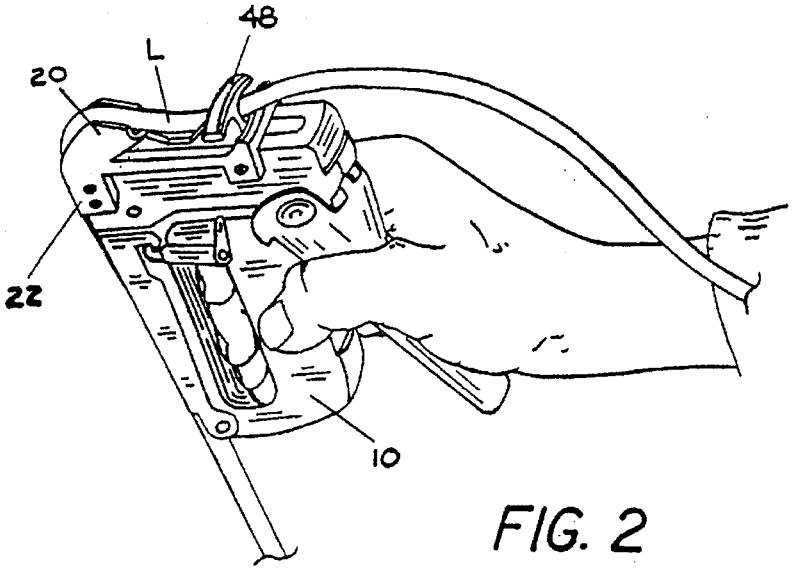
FIG. 2 is an isometric view of the stapler and attached guiding and gripping means of FIG. 1, this view taken from above the stapler showing it in use on a line.

With particular reference to the drawings, the present invention is for use with staplers of the type having a narrow body member 10 that houses a staple plunger (not shown) operated by handle trigger assembly 12. It is to be understood that the stapler may be power operated or manually driven. The body member has a bottom magazine 14 with a flat bottom surface 16. The upright front edge 18 of the body member is straight.

Referring first to FIGS. 1–6 the guiding and gripping means of the invention is shown as an attachment for application to existing staplers. The function of the attachment is to form a stapler structure that is useful in applying a plurality of staples 56, FIG. 8, along a length of line in an efficient and easy manner. It comprises a body portion 20 having rearwardly extended flanges 22 or pairs of arms that straddle the sides of the stapler adjacent the front of the stapler. The body portion lies against the front edge of the stapler when installed. The device can be mounted on a stapler by threaded set screw receptacle inserts 26 that are mounted in apertures 28 in the flanges 22 and that receive set screws 30, FIG. 5, that pass through the insert and bear tightly against the sides of the stapler. It is apparent that the guiding and gripping means can be installed and removed simply by tightening or removing the set screws.

The body member 20 has means on its front edge that define guiding and gripping surfaces for a line extending upwardly therealong. A line L to be stapled down extends along the bottom surface of the magazine of the stapler as usual for being stapled in place by staples ejected from the stapler. According to the invention, the body portion 20 has a lower forward projection 34 the front and vertical face of which comprises a convex, centrally located, V-shaped groove 36. The V-shaped groove at the bottom thereof is aligned with the bottom surface of the stapler and magazine whereby a line L being stapled can move axially between the stapler and projection 34 when the stapler is moved forwardly along an unattached portion of the line. A portion or portions of the side walls of the groove 36 have cooperating angled ribs or hatches **36*a*** that add to gripping engagement on a line, to be described.

The upper end of the V-shaped groove curves into a vertical front face 38 of the body portion 20. The upper end of the body portion 20 has a forward projecting line guide 40 with a front concaved surface 42. Extending forwardly from an upper portion of face 38 and spaced a short distance down from the line guide 40 is a laterally central support post 46 for an outer end cross head 48 that is curved rearwardly. The post 46 is centered over the groove 36 but is of a width such that side surfaces **46*a*** of the post are offset laterally from the center of the said groove.

The parts are dimensioned and arranged such that side openings 50 are formed between the ends of cross head 48 and the outer ends of line guide 40 and are somewhat restrictive as to inserting a line vertically into engagement with the post 46 from the side. Also, such restricted openings 50 require the line to be bent when the line is being threaded in from the sides as apparent in a broken line representation of a line L, FIG. 6, being operated upon by the present stapler. Thus the line will be urged to remain behind the curved head 48 when the stapler moves along the line.

Figure 7:
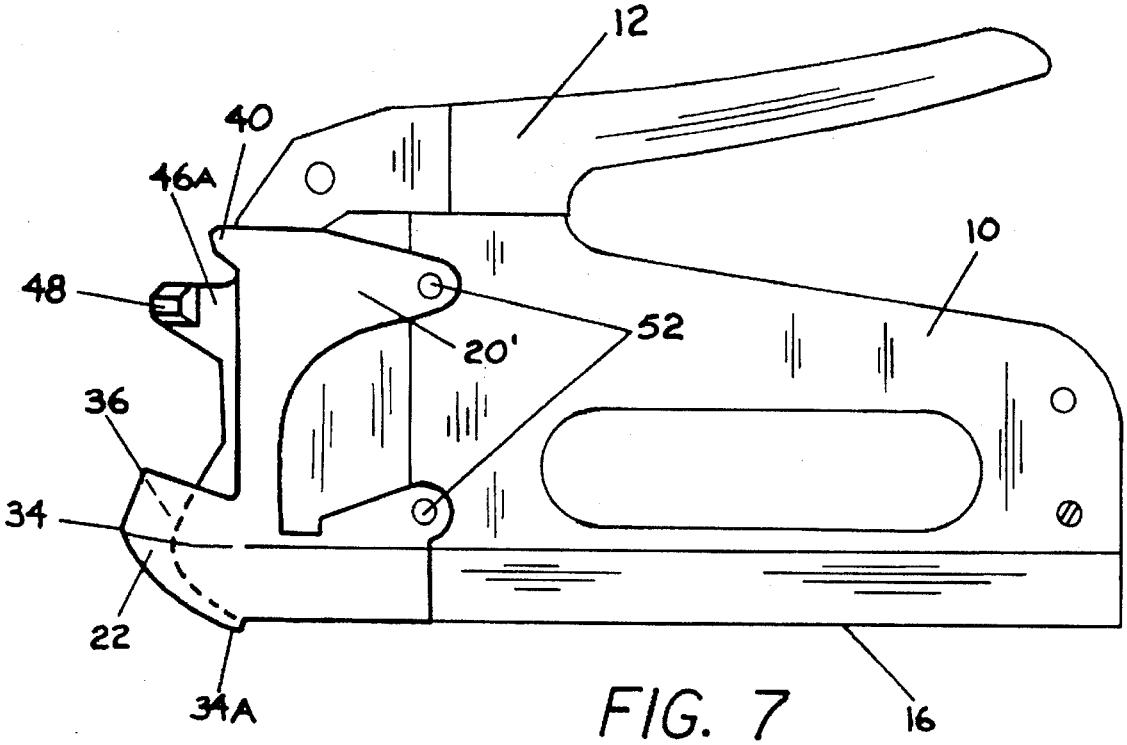
FIG. 7 is a side elevational view of the guiding and gripping means of the invention as comprising an integral factory part of a stapler.
Figure 8:
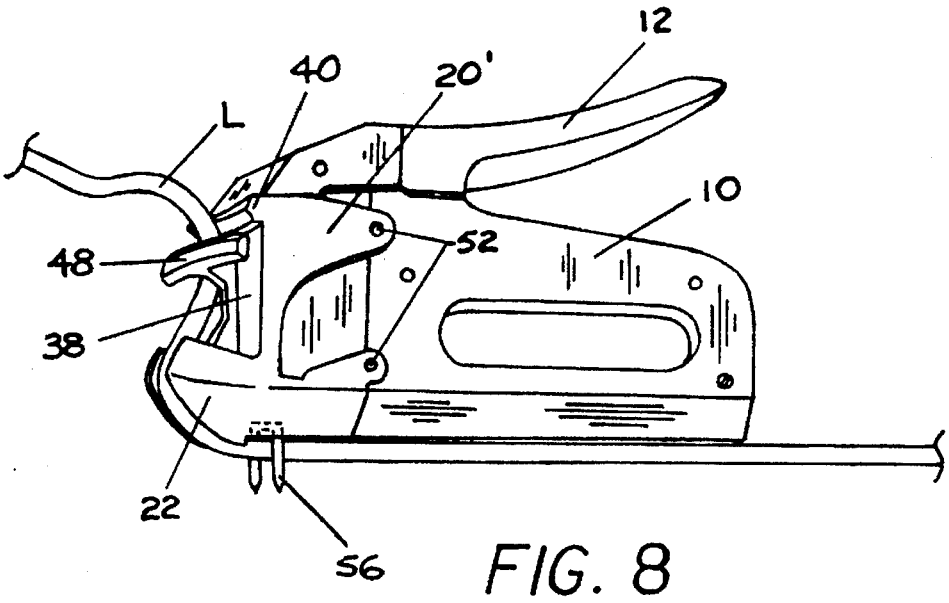
FIG. 8 is an isometric view of the FIG. 7 embodiment and showing the stapler in use.
Figure 9:
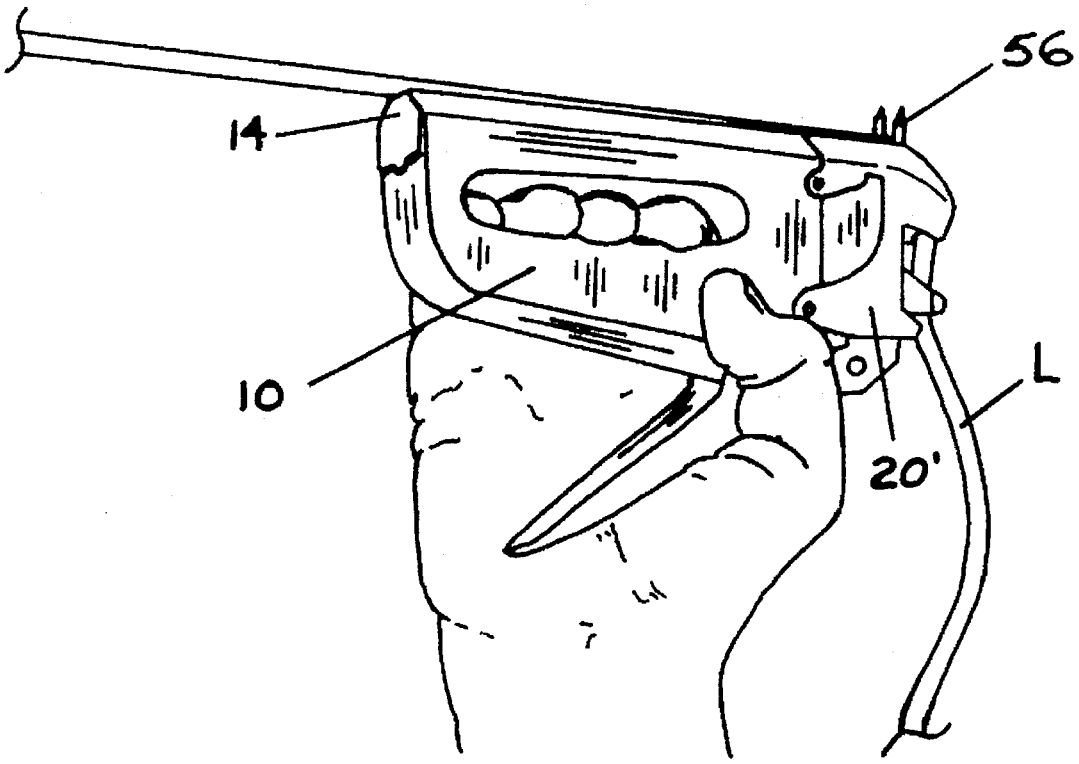
FIG. 9 is a side elevational view illustrating use of the stapler that requires it to be manipulated upside down.

FIGS. 7, 8 and 9 show a second embodiment of the invention wherein the body member 20' of the line guide and gripping means of the invention comprises an integral part of the stapler, such as a factory installed line guide and gripping means. This part of the stapler may be riveted, as by rivets 52 or by other suitable integrating means. Otherwise, the line guiding and gripping means is identical to that of FIG. 1, including the operation, now to be described.

In operation, the invention has particular usage in applying a length of line to a surface. In use, a portion of the line is anchored to the surface and an adjacent portion of unattached line is threaded forwardly around the V-shaped groove 36 and up along the flat upper face 38 and then through one of the upper side openings 50. As noted hereinbefore, threading the line in from the side through openings 50 requires it to be bent so as to work it through into an inner area in engagement with the post. The line is confined in this position by the groove 36 and the rounded rear surface of the cross head 48. The stapler can thus be moved axially along the line with one hand.

Also, with the unattached portion of the line in place on the front surface of the guide, it is gripped somewhat by friction as it extends along such surface. Contributing to this friction grip first is the bend of the wire around the groove 36 at the bottom and friction contact with the surface of the groove and ribs **36*a* as the stapler is slid along the line. Also the line must be bent laterally, FIG. 5, as it passes to one side or the other of the post 46 and back of the head 48. These line bends are sufficient to provide a frictional grip between the line and the stapler but will let the stapler slide axially along the wire. At the same time, the grip between the stapler and the line is such that the stapler can be moved along a line and holds the line firmly in the position desired for stapling. Thus, usually only one hand is necessary for stapling. The line can be inserted on either side of the post 46. As the stapler moves along the line, the groove 36 maintains the line in its upright position and also such groove aligns the wire with the bottom of the stapler so that the stapler will straddle a line and not damage the line. Groove 36** is sufficiently wide to accommodate various diameters of line.

Figure 3:
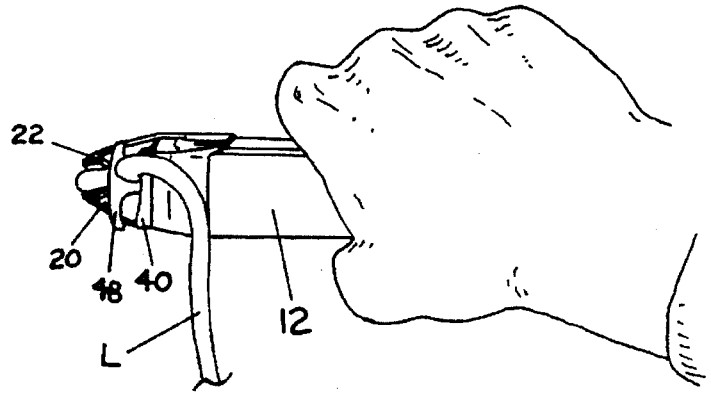
FIGS. 3 and 4 are top plan views of the stapler of FIG. 1 showing right and left hand operations thereof.
Figure 4:
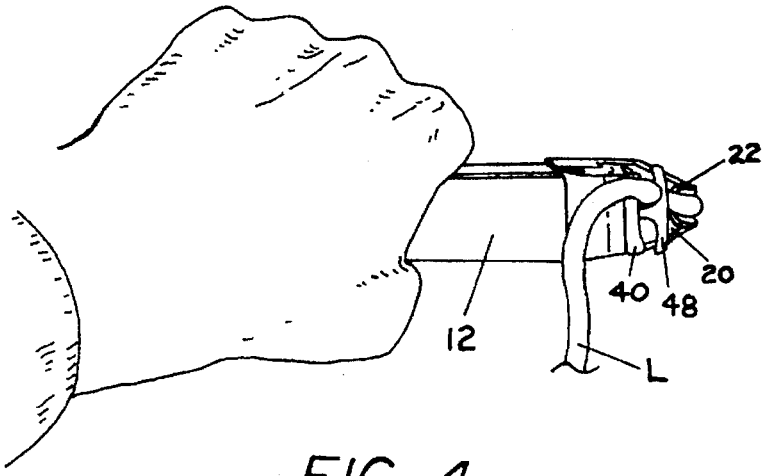
Figure 5:
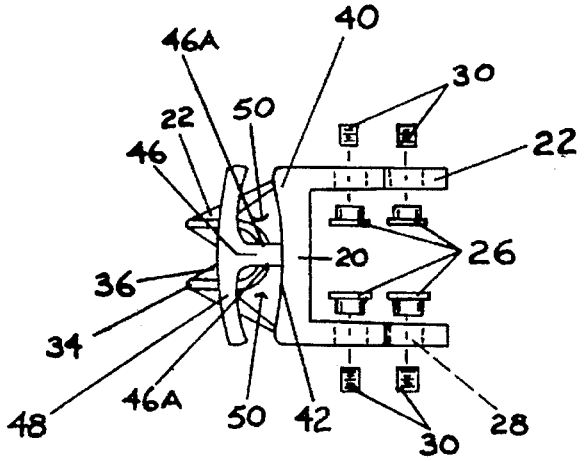
FIG. 5 is a top plan view of the guiding and gripping means of FIG. 1 apart from the stapler and also detailing means for attaching the device in place.
Figure 6:
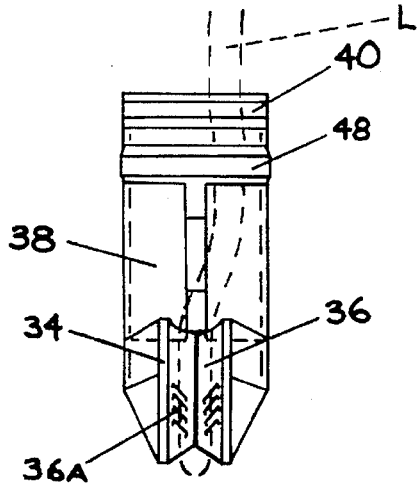
FIG. 6 is a front elevational view of the guiding and gripping means of FIG. 1.

FIGS. 3 and 4 show right and left operation of the stapler and also right and left positioning of the line relative to the post 46. FIG. 9 also illustrates upside down use of the stapler.

It is to be understood that the forms of our invention herein shown and described are to be taken as preferred examples of the same and that various changes in the shape, size and arrangement of parts may be resorted to without departing from the spirit of our invention, or the scope of the subjoined claims.

Having thus described our invention, we claim:

1. Guiding and gripping means for staplers of the type having a front surface and opposite side surfaces and also having a bottom surface through which a staple is driven, said guiding and gripping means comprising:

a) a body member configured to be affixed in upright relation to the front surface of a stapler and to extend upwardly from the bottom surface thereof, b) an immovable front contoured surface on said body member configured to receive a line being stapled to a surface and to guide an unattached portion of the line extending from the bottom surface of the stapler upwardly along said front contoured surface, c) said front contoured surface also being configured to position a line centrally along the bottom surface of the stapler in a position that is straddled by a staple to be driven out of the bottom surface of the stapler, d) immovable friction means on said front contoured surface for frictionally gripping the line to allow a tension of the unattached portion of the line by advancing movement of the stapler along the line in the direction away from a fixed portion of the line, e) the friction means including a convex V-shaped groove for receiving the line bent thereover that is being stapled by the stapler and that is extended upwardly over said groove, said groove having a center and being of a curvature that imparts said frictional gripping force on the line when the line is held in upright position thereover, f) said immovable friction means also including a projection positioned above said groove and having a center aligned with the center of said groove, said projection having at least one side guide surface offset laterally from the center of said groove to bend the line laterally from said groove into angled engagement against said projection to further impart frictional gripping force on the line.

2. The guiding and gripping means of claim 1 wherein said projection has laterally opposite side guide surfaces to impart said frictional gripping force on the line upon extending the line into engagement with either side of the projection.

3. Guiding and gripping means for stapler of the type having a front surface and opposite side surfaces and also having a bottom surface through which a staple is driven, said guiding and gripping means comprising:

a) a body member configured to be affixed in upright relation to the front surface of a stapler and to extend upwardly from the bottom surface thereof, b) an immovable front contoured surface on said body member configured to receive a line being stapled to a surface and to guide an unattached portion of the line extending from the bottom surface of the stapler upwardly along said front contoured surface, c) said front contoured surface comprising bottom guide means having a guide center and configured to position a line centrally along the bottom surface of the stapler in a position that is straddled by a staple to be driven out of the bottom surface of the stapler, and b) immovable friction means on said front contoured surface for frictionally gripping the line to allow a tensioning of the unattached portion of the line by advancing movement of the stapler along the line in a direction away from a fixed portion of the line, e) said immovable friction means including a projection positioned above said bottom guide means and having a center aligned with the center of said guide means, said projection having at least one side guide surface offset laterally from the center of said bottom guide means for bending the line laterally from said bottom guide means into angled engagement against the said at least one side guide surface of said projection to impart frictional gripping force on the line.

4. A stapler comprising:

a body member having a front surface, opposite side surfaces and a bottom surface, staple driving means in said body member for forcefully driving a staple through said bottom surface, a line guide on the front surface of said body member having an immovable contoured surface configured to receive a line being stapled to a surface and to guide an unattached portion of the line extending from said bottom surface upwardly along said immovable contoured surface, said contoured surface having a center and being configured to position a line centered along said bottom surface in a position that is straddled by a staple to be driven out of the bottom surface of the stapler, and immovable friction means on said immovable contoured surface having a center aligned with the center of said contoured surface and at least one side guide surface offset laterally from the center of said contoured surface for frictionally gripping the line to allow a tensioning of the unattached portion of the line by advancing movement of the stapler along the line in the direction away from a fixed portion of the line.

5. The stapler of claim 4 wherein said immovable friction means includes a convex V-shaped groove for receiving said line bent thereover that is being stapled and that is extended upwardly over said groove, said groove having a center and being of a curvature that imparts said frictional gripping force on the line when the line is held in upright position thereover.

6. The stapler of claim 5 wherein said immovable friction means also includes a projection positioned above said groove and having a center aligned with the center of said groove, said projection having at least one side guide surface offset laterally from the center of said groove to bend the line laterally from said groove into angled engagement against said at least one side guide surface of said projection to further impart frictional gripping force on the line.

7. The stapler of claim 6 wherein said projection has laterally opposite side guide surfaces to impart said frictional gripping force on the line upon extending the line into engagement with either side guide surface.

8. The stapler of claim 4 wherein said immovable contoured surface comprises bottom guide means for positioning the line centered along the bottom surface of the body member, said bottom guide means having a guide center, said immovable friction means including a projection positioned above said bottom guide means and having a center aligned with the center of said bottom guide means, said projection having at least one side guide surface offset laterally from the center of said bottom guide means to bend the line laterally from said bottom guide means into angled engagement against said at least one side guide surface of said projection to impart frictional gripping force on the line.

* * * * *